US006270255B1

(12) United States Patent
Kaufman et al.

(10) Patent No.: US 6,270,255 B1
(45) Date of Patent: Aug. 7, 2001

(54) OPENING SYSTEM FOR BEVERAGE CONTAINER

(75) Inventors: Richard H. Kaufman, Chappaqua, NY (US); Ivica M. Labuda, Mahwah, NJ (US)

(73) Assignee: Kraft Foods, Inc., Northfield, IL (US)

( * ) Notice: Subject to any disclaimer, the term of this patent is extended or adjusted under 35 U.S.C. 154(b) by 367 days.

(21) Appl. No.: 08/844,282

(22) Filed: Apr. 18, 1997

(51) Int. Cl.[7] ..... B65D 33/34

(52) U.S. Cl. ..... 383/5; 383/35; 383/44; 383/202; 383/210

(58) Field of Search ..... 383/35, 210, 211, 383/202, 104, 120, 61, 904, 906, 5, 44

(56) References Cited

U.S. PATENT DOCUMENTS

| | | | | |
|---|---|---|---|---|
| 2,390,822 | * | 12/1945 | Wren | 383/211 X |
| 2,799,314 | * | 7/1957 | Dreyer et al. | 383/904 X |
| 3,085,738 | * | 4/1963 | Bok | 383/61 X |
| 3,337,117 | * | 8/1967 | Lehmacher et al. | 383/120 X |
| 3,342,326 | * | 9/1967 | Zackheim | 383/210 X |
| 3,380,646 | | 4/1968 | Doyen et al. . | |
| 3,456,867 | * | 7/1969 | Repko | 383/61 X |
| 3,474,789 | * | 10/1969 | Soto | 383/61 X |
| 4,010,786 | * | 3/1977 | Aguettant et al. | 383/202 |
| 4,232,026 | * | 11/1980 | Bayham | 383/210 X |
| 4,294,360 | * | 10/1981 | LeVeen | 383/210 X |
| 4,786,190 | * | 11/1988 | VanErden et al. | 383/61 |
| 5,050,736 | | 9/1991 | Griesbach et al. . | |
| 5,121,996 | * | 6/1992 | Scarrow | 383/44 |
| 5,330,269 | * | 7/1994 | Kamada et al. | 383/5 X |
| 5,358,334 | * | 10/1994 | Simonsen | 383/61 X |
| 5,425,583 | | 6/1995 | Wild . | |

FOREIGN PATENT DOCUMENTS

| | | | | |
|---|---|---|---|---|
| 215885 | * | 6/1961 | (DE) | 383/94 |
| 2647399 | * | 5/1977 | (DE) | 383/907 |
| 1128387 | * | 1/1957 | (FR) | 383/44 |
| 639809 | * | 5/1962 | (IT) | 383/105 |
| 57560 | * | 2/1990 | (JP) | 383/44 |
| WO 95 33663 | | 12/1995 | (WO) . | |

* cited by examiner

*Primary Examiner*—Jes F. Pascua
(74) *Attorney, Agent, or Firm*—Thomas A. Marcoux

(57) ABSTRACT

An easy-open beverage container and opening system therefor includes first and second barrier walls having top edges and upper portions of opposite side edges which matingly face one another and which form an open top therebetween. A bifold membrane with a longitudinal fold is located in the open top. A membrane attachment securely attaches peripheral edges of the bifold membrane to adjacent top edges and upper portions of the opposite side edges such that the bifold membrane closes the open top and the facing top edges of the barrier walls are movable away from one another to expose the longitudinal fold for piercing by a straw. In a preferred embodiment, a side attachment securely attaches facing portions of the peripheral edges of the bifold membrane adjacent the upper portions of the opposite side edges so that the facing upper portions of the opposite side edges are not movable away from one another and thus the facing top edges tend to stay together and protect the bifold membrane. In another preferred embodiment, the opening system further includes a peel seal provided between facing portions of the peripheral edges of the bifold membrane adjacent the top edges of the barrier walls. The peel seal provides a tamper-evident and sanitary seal for the bifold membrane which is, easily broken. For easier opening of the peel seal, a respective pull tab or extension is present adjacent to respective peripheral edges of the bifold membrane adjacent the top edges of the barrier walls.

8 Claims, 2 Drawing Sheets

OPENING SYSTEM FOR BEVERAGE CONTAINER

FIELD OF THE INVENTION

The present invention relates generally to beverage containers which are pierced by a straw to consume a beverage therein, and more particularly to a bag-shaped beverage container having a bifold membrane which is exposed and pierced by the straw to access the beverage.

BACKGROUND OF THE INVENTION

In bag-shaped (flexible pouch) beverage containers having a membrane seal which is to be pierced by a pointed straw, such as CAPRI SUb® or like containers which are shown in U.S. Pat. No. 3,380,646 (Doyen et al.), there is a problem of providing a sufficiently strong membrane seal to withstand the rigors of shipping while still making the membrane seal sufficiently easy for the consumer to pierce with a straw. The piercing of the membrane seal may be a particular problem for small children who frequently utilize such containers and who lack the dexterity of adults.

Typical of opening systems in the prior art are those where a small hole is provided in a barrier wall of the container, with the hole then being covered with a pierceable membrane seal. While such a membrane seal is mostly satisfactory, it is often difficult for young children (ages 4–9) to use since the membrane must be struck with the straw only in the hole in the barrier wall and at the same time with somewhat of a downward angle so that the straw does not pierce as well the back barrier wall of the container. In addition, as the membrane seal is pierced, squeezing of the bag-shaped container to hold the container steady during piercing may result in the beverage being pushed up around the outside of the straw and out of the straw hole causing undesired spillage.

SUMMARY OF THE INVENTION

In accordance with the present invention, an easy-open beverage container and opening system therefor are provided in which a beverage in the container is designed to be consumed through a straw. The opening system for the beverage container includes a first barrier wall and a second barrier wall, each barrier wall having top edges and upper portions of opposite side edges which matingly face one another and which form an open top therebetween. A bifold membrane is located in the open top and this membrane has a longitudinal fold and peripheral edges disposed adjacent the top edges and upper portions of the opposite side edges of the first and second barrier walls. A membrane attaching means securely attaches the peripheral edges of the bifold membrane to adjacent top edges and upper portions of the opposite side edges of the barrier walls such that the bifold membrane closes the open top. While the open top is closed, the facing top edges of the barrier walls are movable by the user away from one another about the longitudinal fold of the bifold membrane to expose the longitudinal fold for piercing by the straw.

In one embodiment, the bifold membrane is a simple polyethylene film which is otherwise protected, such as by a barrier peel seal. In another embodiment, the bifold membrane is a barrier layer, such as a sealing foil which provides its own protection.

In a preferred embodiment, the opening system further includes a side attaching means for securely attaching facing portions of the peripheral edges of the bifold membrane adjacent the upper portions of the opposite side edges of the barrier walls to one another. With this construction, the facing top edges of the barrier walls are movable away from one another but the facing upper portions of the opposite side edges are not so that the facing top edges tend to stay together and protect the bifold membrane.

In another preferred embodiment, the opening system includes not only the side attaching means but a peel seal as well provided between facing portions of the peripheral edges of the bifold membrane adjacent the top edges of the barrier walls. With this construction, the peel seal provides a tamper-evident and sanitary seal for the bifold membrane which is easily broken in order to move the facing top edges away from one another. For easier opening, a respective tab is attached to, or integral with, respective peripheral edges of the bifold membrane adjacent the top edges of the barrier walls. These tabs extend above the top edges so that the peripheral edges of the bifold membrane adjacent the top edges are easily pulled apart with the tabs to expose the longitudinal fold of the bifold membrane.

It is an object of the present invention to provide a simple to manufacture, easy-open beverage container having a pierceable bifold membrane.

It is also an object of the present invention to provide an easy-open opening system for a beverage container with no removable elements.

It is a further object of the present invention to provide an opening system with a membrane seal which is easily pierced while holding the beverage container at the top so that the beverage container does not have to be squeezed while the membrane seal is pierced.

It is a still further object of the present invention to provide an opening system with a peel seal so that the bifold membrane is kept sanitary until use and so that the opening system is thus tamper-evident should the peel seal be pulled far enough apart to access the bifold membrane.

Other features, advantages and objects of the present invention are stated in or apparent from the detailed description of presently preferred embodiments of the invention found hereinbelow.

DESCRIPTION OF THE PREFERRED EMBODIMENTS

Figure 1:
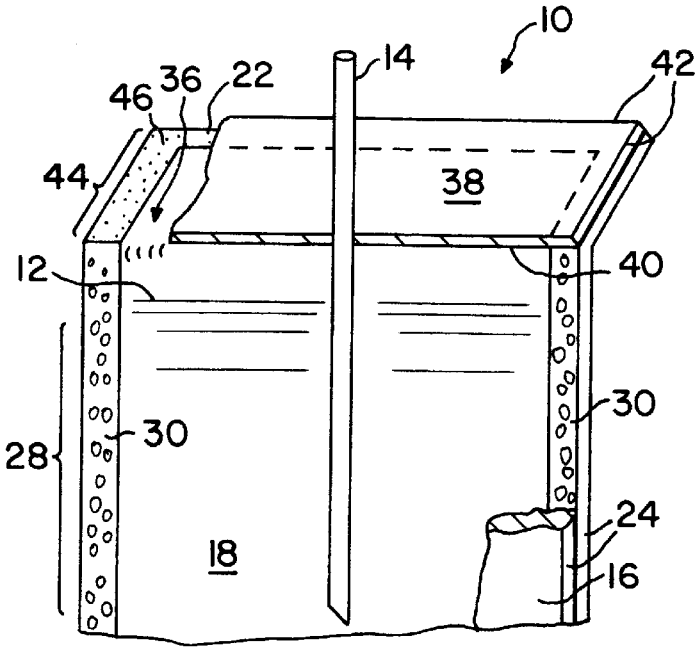
FIG. 1 is a front perspective view of an upper portion of a beverage container according to a first embodiment of the present invention with all but a small portion of a first barrier wall cut away and with a complementary and side portion of a bifold membrane also cut away.
Figure 2:
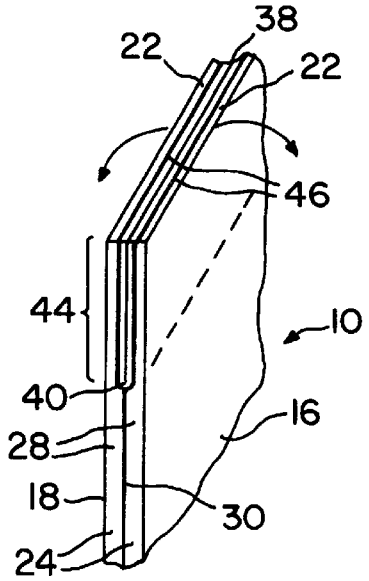
FIG. 2 is a side perspective view of a portion of the top of the beverage container depicted in FIG. 1.

With reference now to the drawings in which like numerals represent like elements throughout the views, a first embodiment of a beverage container 10 is depicted in FIGS. 1–2 in which a beverage 12 is contained. It will be appreciated that attaching means, typically in the form of heat (weld) seals or suitable adhesives well known in the art, secure facing edges (borders) of the layers of the materials comprising the beverage container together, and that such attaching means are depicted with heavy lines or stippling in FIGS. 1–2 as well as the remainder of the drawings as discussed below. It will also be appreciated that the thickness of the layers and attaching means have been exaggerated for clarity in the drawings. Beverage 12 is designed to be consumed from container 10 by use of a straw 14 inserted into container 10.

Figure 3:
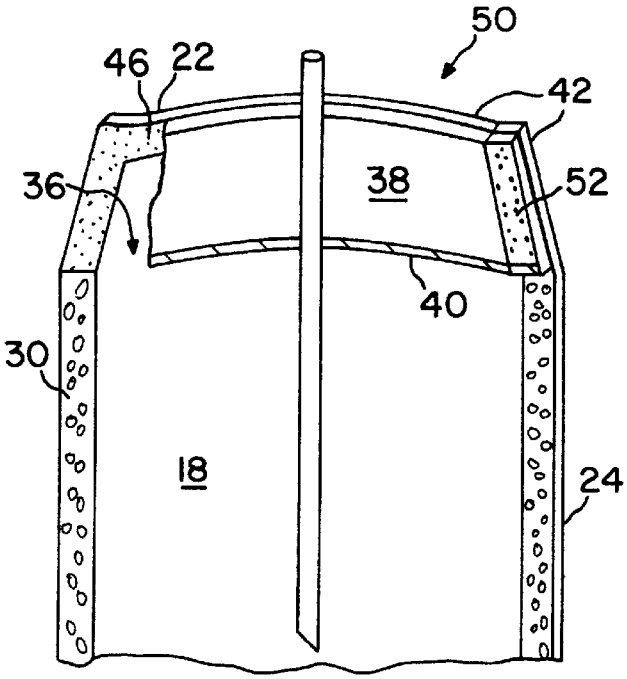
FIG. 3 is a front perspective view of an upper portion of a beverage container according to a second embodiment of the present invention with the first barrier wall and portions of the bifold membrane cut away.

Container 10 is conveniently a flexible pouch or bag-shaped type of container such as used for CAPRI SUN®, which includes a first or front barrier wall 16 which is depicted mostly cut away in FIG. 1 to show a second or back barrier wall 18 facing or opposite to first barrier wall 16. As appreciated by those in the art, barrier walls 16 and 18 are suitably formed as a sealing foil, either a mono-material or a multi-layer compound material both of which are well known. Barrier walls 16 and 18 matingly face one another and each barrier wall 16 and 18 includes a bottom edge 20, a top edge 22 and opposite side edges 24. Located at the bottom of beverage container 10 is a bottom barrier 26 as shown in FIG. 3.

Typically, barrier walls 16 and 18 are together along facing side edges except at the very bottom of side edges. In addition, peripheral edges of a bottom barrier wall are attached to adjacent the bottom edges of barrier walls 16 and 18 to form a closed bottom for beverage container 10 which bottom is capable of being spread apart and serving as a stand for beverage container 10. When so formed, beverage container 10 is a liquid holding bag having an open top 36 through which beverage container 10 is filled with beverage 12 before the open top 36 is closed. This arrangement is generally described in the aforementioned Doyen et al patent and in U.S. Pat. No. 5,425,583 both of which are hereby incorporated by reference.

A downwardly extending bifold membrane 38 is disposed in open top 36 to hermetically close open top 36. Bifold membrane 38 includes a longitudinal fold 40 as well as peripheral edges 42. Peripheral edges 42 are disposed adjacent top edges 22 and upper portions 44 of opposite side edges 24 of barrier walls 16 and 18. A membrane attaching means 46 securely attaches peripheral edges 42 of bifold membrane 38 to upper portions 44 of side edges 24 as well as adjacent to top edges 22, which completely closes open top 36.

Conveniently, bifold membrane 38 may be formed of a plastic (e.g., polyethylene) film which provides a sanitary barrier for open top 36. Where bifold membrane 38 is made of polyethylene film, bifold membrane 38 is easily pierceable by a pointed end of straw 14 as shown, and the elastic nature of the film causes the film to automatically form a tight seal about straw 14 after piercing to avoid spillage of beverage 12 around straw 14. For added protection, bifold membrane could be a barrier layer made of the same barrier material as barrier walls 16 and 18 or some other barrier material, such as EVOH, foil, polyvinylidine chloride, etc. which are well know in the art. When made of as a barrier layer, it would typically require some additional force to pierce with straw 14.

When manufactured, bifold membrane 38 would be applied to open top 36 after filling of beverage container 10 with beverage 12 through open top 36. During shipping, etc., both top edges of barrier walls 16 and 18 would be upright or close together as shown in FIG. 2 with bifold membrane 38 folded together therebetween. The resilience of barrier walls 16 and 18 would tend to hold bifold membrane in this folded position, helping to prevent any contaminants from being deposited on the outside of bifold membrane 38. However, when the user desired to consume beverage 12, respective top edges 22 of barrier walls 165 and 18 would be easily separated from one another as depicted by the arrows in FIG. 2 so that bifold membrane 38 would be spread open as depicted in FIG. 1. In this position, it is an easy matter for the user to hold beverage container 10 by top edges 22 and then to pierce bifold membrane 38 by thrusting the pointed end of straw 14 down onto bifold membrane 38 with sufficient thrust. In this manner, straw 14 pierces bifold membrane 38 at or near longitudinal fold 40 to access beverage 12 in beverage container 10 without striking either barrier wall 16 or 18 except at a very small angle insufficient to also pierce barrier wall 16 or 18 and without squeezing of beverage container 10 since beverage container 10 is held by top edges 22.

Figure 4:
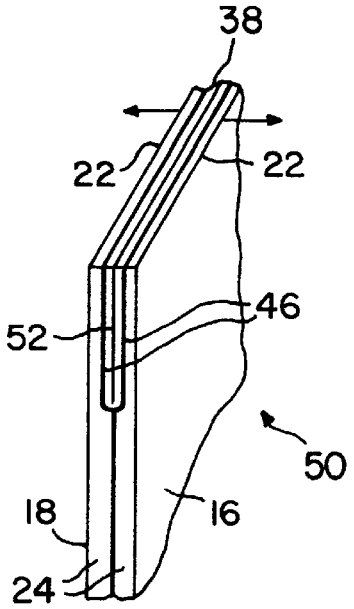
FIG. 4 is a side perspective view of a portion of the top of the beverage container depicted in FIG. 3.

Depicted in FIGS. 3–4 is an alternative embodiment of a beverage container 50 which is similar to beverage container 10. For that reason and for simplicity, the elements of beverage container 50 which are the same as those of beverage container 10 are designated with the same identifying numbers. Beverage container 50 is different from beverage container 10 in that a side attaching means 52 securely attaches together facing portions of peripheral edges 42 of bifold membrane 38 adjacent upper portions 44 of opposite side edges 24. Thus, it will be appreciated that only facing portions of peripheral edges 42 adjacent top edges 22 can be pulled apart as shown by the arrows in FIG. 4 to expose longitudinal fold 40 of bifold membrane 38. As this opening occurs, upper portions 44 of facing side edges 24 are pulled centrally (toward straw 14) as shown in an exaggerated manner in FIG. 3 since the facing portions of peripheral edges 42 adjacent upper portions 44 of sides edges 24 cannot be pulled apart.

With beverage container 50, top edges 22 of barrier walls 16 and 18 tend to stay together during shipping and handling since side attaching means 52 keeps facing side edge 24 together all of the way to top edges 22. This helps to keep any contamination from falling into bifold membrane 38. The attaching together of upper portions 44 of adjacent side edges 24 also helps to assure that straw 14 is inserted downwardly through longitudinal fold 40 as bifold membrane 10 is pierced in the same manner as described above for beverage container 10, as straw 14 cannot slip laterally off of longitudinal fold 40 during straw insertion without engaging attached together peripheral (side) edges of bifold membrane 38.

Figure 6:
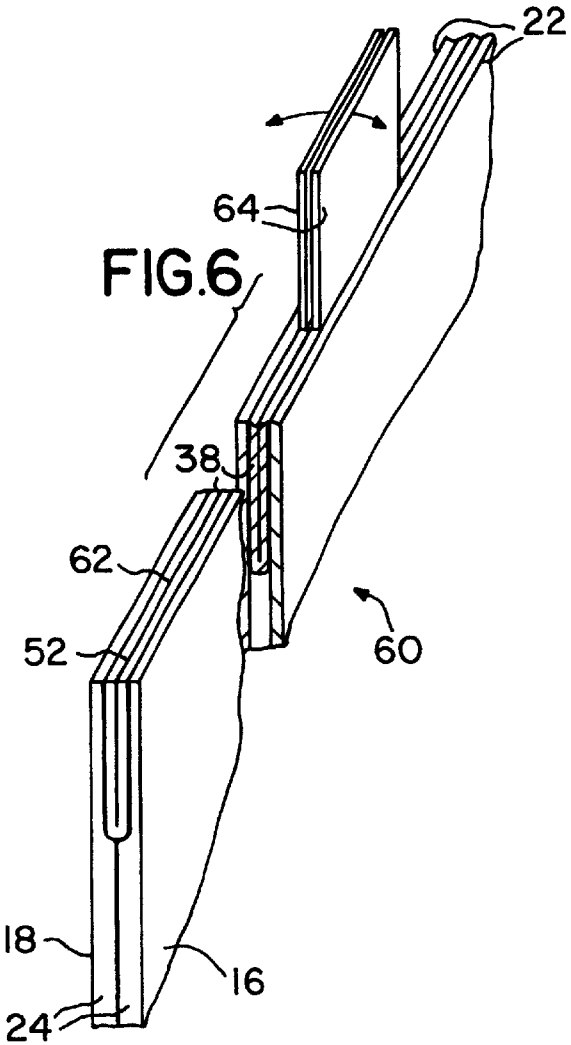
FIG. 6 is a side perspective view of a broken portion of the top of the beverage container depicted in FIG. 5.
Figure 5:
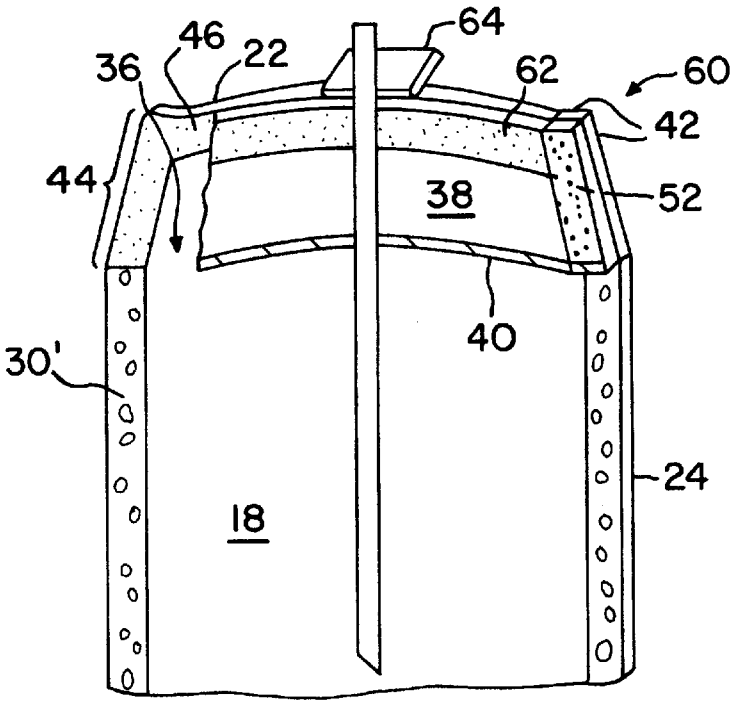
FIG. 5 is a front perspective view of an upper portion of a beverage container according to a third embodiment of the present invention with the first barrier wall and portions of the bifold membrane cut away.

Depicted in FIGS. 5–6 is another alternative embodiment of a beverage container 60 which is similar to beverage container 50. For that reason and for simplicity, the elements of beverage container 60 which are the same as those of beverage container 50 (and hence of beverage container 10) are designated with the same identifying numbers. Thus, it will be appreciated that beverage container includes side attaching means 52 in the same manner as beverage container 50. In addition, a peel seal 62 is provided between facing portions of peripheral edges 42 adjacent top edges 22 of barrier walls 16 and 18. Peel seal 62 is preferably a weak heat seal, with an opening force of about 1–6 pounds, and preferably about 2.5–3.5 pounds.. This peel seal will create a barrier seal which prevents oxygen from reaching bifold membrane 38, an important feature in embodiments where bifold membrane 38 is itself not a barrier layer. Peel seals of this type are described in U.S. Pat. No. 5,050,736 (Griesbach et al.), which is hereby incorporated by reference.

In order to make it easier to separate top edges 22 of barrier walls 16 and 18 and to rupture the peel seal, a respective tab 64 may be secured between or to peripheral edges 42 of bifold membrane 38 and/or top edges 22 of barrier walls 16 and 18, as shown in FIG. 6. Tabs 64 are not secured to one another above top edges 22. Thus, when a user desires to consume beverage 12 from beverage container 60, the user simply grasps each tab 64 with a separate hand and pulls tabs 64 apart as shown by the arrows in FIG. 6. This causes peel seal 62 to be broken and exposes longitudinal fold 40 for piercing by straw 14 in the same manner as described above for beverage container 50 where top edges 22 are grasped.

As an alternative to tabs 64 being separate elements which are each sealed in the top seal structure, integral, die-cut, upwardly-extending tabs may be formed in top edges 22 of barrier walls, 16 and 18 or in top peripheral edges 42 of bifold membrane 38. The die-cut tabs would typically be semi-circular in shape; however other configurations could be used. In each instance tabs would be available for the user to pull apart in a similar manner to tabs 64. As an alternate to tabs, another approach would be unsealed extensions of the top edges 22 of barrier walls 16 and 18 or top peripheral edges 42 of bifold membrane 38. These unsealed extensions would also provide a gripping surface to facilitate breaking of the peel seal.

With this construction of beverage container 60, peel seal 62 provides a tamper-evident seal for beverage container 60. In addition, peel seal 62 also provides a sanitary seal so that no contamination can be deposited on the surface of bifold membrane 38 prior to opening by the user.

While the present invention has been described with respect to exemplary embodiments thereof, it will be understood by those of ordinary skill in the art that variations and modifications can be effected within the scope and spirit of the invention.

What is claimed is:

1. An easy-open beverage container in the form of a flexible pouch in which a beverage therein is consumed through a straw comprising:

a front barrier wall and a back barrier wall, each said barrier wall including top edges and upper portions of opposite side edges which matingly face one another and which form an open top therebetween;

a downwardly-extending bifold membrane located in the open top and having a longitudinal fold and peripheral edges disposed adjacent the top edges and upper portions of the opposite side edges of said front and back barrier walls;

a membrane attaching means for securely attaching the peripheral edges of said bifold membrane to adjacent top edges and upper portions of the opposite side edges of said barrier walls such that said bifold membrane completely closes the open top and the facing top edges of said barrier walls are movable away from one another about the longitudinal fold of said bifold membrane to expose the longitudinal fold for piercing by the straw;

side attaching means for securely attaching facing portions of the peripheral edges of said bifold membrane adjacent the upper portions of the opposite side edges of said barrier walls to one another whereby the facing upper portions of the opposite side edges are not movable away from one another; and a barrier peel seal provided between facing portions of the peripheral edges of said bifold membrane adjacent the top edges of said barrier walls whereby said peel seal provides a tamper-evident and sanitary seal for said bifold membrane which is easily broken in order to move the facing top edges away from one another to expose said longitudinal fold of said bifold membrane, wherein said peel seal is a weak heat seal.

2. An easy-open beverage container as claimed in claim 1 and further including a respective tab attached to respective said peripheral edges of said bifold membrane adjacent said top edges of said barrier walls, said tabs extending above said top edges whereby said peripheral edges of said bifold membrane adjacent said top edges are easily pulled apart with said tabs to expose said longitudinal fold of said bifold membrane.

3. An easy-open beverage container as claimed in claim 2 wherein said bifold membrane is an easily pierceable film.

4. An easy-open beverage container as claimed in claim 1 and further including a respective tab or extension extending above said top edges whereby said peripheral edges of said bifold membrane adjacent said top edges are easily pulled apart with said tabs or extensions to expose said longitudinal fold of said bifold membrane.

5. An easy-open beverage container as claimed in claim 4 wherein said bifold membrane is an easily pierceable plastic film.

6. An easy-open beverage container as claimed in claim 1 wherein said bifold membrane is a barrier layer.

7. An easy-open beverage container as claimed in claim 1 wherein said bifold membrane is a plastic film which is easily pierced by a straw.

8. An easy-open beverage container as claimed in claim 7 wherein said bifold membrane is a polyethylene film.

* * * * *